US005451446A

United States Patent [19]

Kincaid et al.

[11] Patent Number: 5,451,446

[45] Date of Patent: Sep. 19, 1995

[54] THERMOSETTING BINDER FOR AN ABRASIVE ARTICLE

[75] Inventors: Don H. Kincaid, Hudson, Wis.; William J. Schultz, Vadnais Heights; Eric G. Larson, Lake Elmo, both of Minn.

[73] Assignee: Minnesota Mining and Manufacturing Company, St. Paul, Minn.

[21] Appl. No.: 83,215

[22] Filed: Jun. 25, 1993

Related U.S. Application Data

[63] Continuation of Ser. No. 845,214, Mar. 3, 1992, abandoned.

[51] Int. Cl.[6] ..... D06N 7/04

[52] U.S. Cl. ..... 428/143; 428/148; 428/149; 428/283; 428/290; 523/458; 523/466; 523/400

[58] Field of Search ..... 428/283, 289, 290, 148, 428/149, 143; 523/400, 466, 457, 458

[56] References Cited

U.S. PATENT DOCUMENTS

| | | | |
|---|---|---|---|
| 2,951,825 | 9/1960 | Reinking et al. | 260/47 |
| 2,958,593 | 11/1960 | Hoover et al. | 51/295 |
| 3,018,262 | 1/1962 | Schroeder | 260/29.2 |
| 3,298,998 | 1/1967 | McConnell et al. | 260/47 |
| 3,615,303 | 10/1971 | Singer et al. | 51/295 |
| 3,651,012 | 3/1972 | Holub et al. | 260/47 |
| 4,026,705 | 5/1977 | Crivello et al. | 96/27 |
| 4,032,673 | 6/1977 | Schroeder et al. | 427/54 |
| 4,047,903 | 9/1977 | Hesse et al. | 51/298 |
| 4,069,054 | 1/1978 | Smith | 96/115 |
| 4,107,116 | 8/1978 | Riew et al. | 260/23 EP |
| 4,136,102 | 1/1979 | Crivello | 260/440 |
| 4,173,476 | 11/1979 | Smith et al. | 430/280 |
| 4,396,657 | 8/1983 | Ibrahim | 428/36 |
| 4,575,384 | 3/1986 | Licht et al. | 51/308 |
| 4,588,419 | 5/1986 | Caul et al. | 51/295 |
| 4,684,678 | 8/1987 | Schultz et al. | 523/466 |
| 4,707,534 | 11/1987 | Schultz | 528/97 |
| 4,744,802 | 5/1988 | Schwabel | 51/309 |
| 4,751,138 | 6/1988 | Tumey et al. | 428/323 |
| 4,802,896 | 2/1989 | Law et al. | 51/298 |
| 4,822,464 | 4/1989 | Pocius | 204/181.7 |
| 4,964,883 | 10/1990 | Morris et al. | 51/293 |
| 4,983,672 | 1/1991 | Almer et al. | 525/65 |
| 5,011,508 | 4/1991 | Wald et al. | 51/293 |
| 5,045,363 | 9/1991 | Almer et al. | 427/410 |

FOREIGN PATENT DOCUMENTS

| | | | |
|---|---|---|---|
| 0257757 | 3/1988 | European Pat. Off. | B24D 3/28 |
| 0486308 | 5/1992 | European Pat. Off. | B24D 3/34 |

OTHER PUBLICATIONS

Soviet Patents Abstracts, Section Ch, Week 9010, 18 Apr. 1990 SU 1505-769-A.

Japanese Patents Gazette, Section Ch, Week 8623, 16 Jul. 1986 86/146,309.

Japanese Patents Gazette, Section Ch, Week 8640, 12 Nov. 1986 86/260,991.

Patent Abstracts of Japan, vol. 16, No. 249 (C-948)(5292) 8 Jun. 1992 02/167,743.

Patent Abstract, vol. 117, 1992, No. 82101319, vol. 57-Ceramics.

*Primary Examiner*—Christopher W. Raimund

*Attorney, Agent, or Firm*—Gary L. Griswold; Walter N. Kirn; Janice L. Dowdall

[57] ABSTRACT

The invention relates to an abrasive article comprising:

(a) a plurality of abrasive grains; and (b) at least one binder for the abrasive grains, wherein the binder comprises a cured epoxy resin containing a polycyclic aryl, polycyclic alkyl, or cycloalkyl structure. The abrasive articles can comprise bonded, non-woven or coated abrasive articles.

20 Claims, 1 Drawing Sheet

THERMOSETTING BINDER FOR AN ABRASIVE ARTICLE

This is a continuation of application No. 07/845,214 filed Mar. 3, 1992, now abandoned.

FIELD OF THE INVENTION

This invention pertains to abrasive articles comprising a cured modified thermosetting binder. In the case of a bonded abrasive, the cured modified thermosetting binder bonds abrasive grains together to form a shaped mass. In the case of a coated abrasive, the cured modified thermosetting binder holds and supports the abrasive grains on a backing sheet. In the case of a nonwoven abrasive, the cured modified thermosetting binder holds and supports the abrasive grains in a fibrous sheet.

BACKGROUND OF THE INVENTION

Coated abrasives, which are a type of abrasive article, comprise a backing upon which a binder holds and supports a coating of abrasive grains. A typical coated abrasive comprises a "make" coat of a thermosetting resinous binder applied on the front surface of the backing in order to secure the abrasive grains to the backing, and a "size" coat of a thermosetting binder which can be applied over the make coat and abrasive grains in order to firmly bond the abrasive grains to the backing. The binder material of the size coat can be the same material as the binder material of the make coat or of a different material. Examples of typical make and size coats include phenolic resins, urea-formaldehyde resins, urethane resins, melamine-formaldehyde resins, epoxy resins and alkyd resins. The most widely used binder is a resole phenolic resin.

Examples of common coated abrasive backings include cloth, polymeric film, paper, vulcanized fiber, nonwoven webs and combinations and treated versions thereof. If the backing is cloth, the cloth is usually sealed, otherwise the make coat will penetrate into the cloth. The cloth is sealed or treated by applying one or more coats of an adhesive type material. Examples of typical treating adhesives include lattices, styrene-butadiene copolymers, glue, starches, phenolic resins, urea-formaldehyde resins, urethane resins, melamine-formaldehyde resins, epoxy resins and alkyd resins. Bonded abrasives which are a type of abrasive article, comprise abrasive grains bonded together by a binder to form a shaped mass. Nonwoven abrasives, which are a type of abrasive article comprise abrasive grains bonded to a nonwoven substrate.

In recent years, there has been an increasing demand for superabrasives both in the coated and bonded abrasive markets. Superabrasives are abrasive articles that employ abrasive grains that are superior in performance, i.e., greater than 20 times that of conventional abrasive grains in abrading difficult to grind materials such as tool steels or ceramics. Superabrasive grains are typically diamond or cubic boron nitride and these abrasive grains typically cost in excess of one thousand dollars per pound. Conventional abrasive grains include garnet, silicon carbide, silica, aluminum oxide, alumina zirconia, boron carbide, ceramic aluminum oxide and these conventional abrasive grains are typically less than ten dollars per pound. These superabrasive articles grind for periods of time much longer than those of conventional abrasive articles. Additionally, these superabrasive articles are usually used under wet abrading conditions. Thus the binder must have enough water resistance, strength, heat resistance and toughness in order to take full advantage of the superabrasive grain. If the binder fails prematurely, then full utilization of the superabrasive grains is not achieved.

U.S. Pat. No. 3,651,012 (Holub et al.) discusses a bismaleimide binder for use as insulation, protective applications and numerous molding applications. In column 13, line 33 to 45 it mentions that the bismaleimide binder can be used in bonded abrasives.

U.S. Pat. No. 3,615,303 (Singer et al.) discloses a coated abrasive backing treatment, referred to as an intermediate layer, which comprises an epoxide resin mixture based on a) 4,4' dihydroxydiphenyl-2,2-propane (Bisphenol A), b) an epoxide resin based on Bisphenol A internally plasticized by a reaction with castor oil, c) carbamic acid alkyl esters and d) a curing agent.

U.S. Pat. No. 4,047,903 (Hesse et al.) teaches a radiation curable binder comprising a resin prepared by at least partial reaction of (a) epoxy monomers having at least two epoxy groups e.g., from diphenylolpropane and epichlorohydrin, with (b) unsaturated monocarboxylic acids, and (c) optionally polycarboxylic acid anhydride.

U.S. Pat. No. 4,396,657 (Ibrahim) teaches an epoxy resin coatable from water with a dicyandiamide, blocked isocyanates, and/or imidazole curing agents for a saturant to impregnate the multifilament yarns of a stitchbonded coated abrasive backing.

U.S. Pat. No. 4,575,384 (Licht et al.) teaches that polyimide binders can be employed in a coated abrasive construction.

U.S. Pat. No. 4,588,419 (Caul) teaches an adhesive for coated abrasives comprising a mixture of: (a) electron beam radiation curable resin system comprising an oligomer selected from the group consisting of: urethane acrylates and epoxy acrylates, a filler and a diluent and (b) a thermally curable resin selected from the group consisting of: phenolic resins, melamine resins, amino resin, alkyd resins and furan resins.

U.S. Pat. No. 4,751,138 (Tumey et al.), assigned to the assignee of the present case, involves a coated abrasive in which either the make coat or the size coat comprises an ethylenically unsaturated compound, an epoxy monomer and a photoinitiator.

U.S. Pat. No. 4,684,678 (Schultz et al.), assigned to the assignee of the present case, teaches epoxy compositions that employ 9,9-bis(aminophenyl)fluorenes as curing agents. The resulting cured epoxy formulation has a high glass transition temperature, high ductility and low moisture pick-up.

U.S. Pat. No. 4,802,896 (Law et al.), assigned to the assignee of the present case, pertains to an abrasive bonding system comprising a thermosetting resin and a thermally stable, aromatic ligand. This aromatic ligand comprises a large aromatic moiety around a central metallic ion in a complex compound.

U.S. Pat. No. 4,822,464 (Pocius), assigned to the assignee of the present case, pertains to water compatible resins containing an aryl or cycloalkyl compound having a sufficiently bulky structure to raise the glass transition temperature of a cured epoxy resin by more than 20° C.

U.S. Pat. No. 4,983,672 (Almer et al.), assigned to the assignee of the present case, teaches the use of a binder type material comprising 9,9-bis(hydroxyphenyl) fluorene and an epoxy resin.

However, the above references do not teach the use of a polycyclic aryl, polycyclic alkyl, cycloalkyl, and/or modified epoxy resin having high Tg, thermal resistance, and water resistance in an abrasive article.

A need thus exists in the abrasive industry for a water resistant, tough, heat resistant and strong thermosetting binder which is useful for abrasive articles, particularly superabrasive articles.

SUMMARY OF THE INVENTION

We have found such an abrasive article. The abrasive article of the invention comprises a binder which has a high glass transition temperature which results in excellent heat resistance. Additionally, the binder may have a reduced moisture sensitivity and increased toughness. These properties make the abrasive article ideal for a variety of applications including wet grinding, high pressure applications, and coarse grade applications.

This invention provides abrasive articles comprising abrasive grains and a binder comprising a cured epoxy resin containing a polycyclic aryl, polycyclic alkyl, or cycloalkyl structure. The abrasive articles can comprise bonded abrasive articles in which the thermosetting binder of the invention bonds the abrasive grains together to form a shaped mass. The abrasive articles can comprise non-woven abrasive articles in which the thermosetting binder of the invention bonds the abrasive grains into a porous, lofty, nonwoven substrate. The abrasive articles can also comprise coated abrasive articles in which the thermosetting binder of the invention bonds the abrasive grains to a backing.

In the case of the coated abrasive, the thermosetting binder can be used as the make coat, i.e. the adhesive coat which secures the abrasive grains to the backing. The thermosetting binder can be used as the size coat, i.e. the adhesive coat over the abrasive grains which reinforces the abrasive grains. The thermosetting binder can be used as a supersize coat, i.e, the adhesive coat over the size coat. The thermosetting binder can be used as a backing treatment or coat and this is a preferred aspect of the invention. In particular, the backing may have a saturant coat which saturates the backing. The backing may also have at least one backsize coat which is present on the back side of the backing, opposite the side of the abrasive grains. The backing may have at least one presize coat which is present on the front side of the backing, between the backing and the make coat. Thus, in the case of a coated abrasive the thermosetting binder is used in at least one of the following: a make coat, a size coat, a supersize coat, a backing treatment or coat, a saturant coat, a backsize coat, and a presize coat. In the case of the bonded abrasive, the thermosetting binder can be used to bond the abrasive grains together to form a three dimensional shaped mass. This shaped mass is typically in the form of a wheel.

The following definitions are used herein. The term "abrasive article" as used herein refers to abrasive articles selected from the group consisting of bonded abrasive articles, coated abrasive articles, and nonwoven abrasive articles. The terms "precursor", "binder precursor" and "coat precursor" are used interchangeably herein. The term "precursor" is defined as the resinous type material that has not been polymerized or cured. The precursor may optionally further comprise one or more additives. During the manufacture of the abrasive article, the precursor comprising the thermosetting resin of the invention is exposed to an appropriate energy source, initiates the polymerization or curing of the thermosetting resin. After the polymerization or curing step, the modified thermosetting resin of the invention is a cured polymer network. The terms "curing" and "polymerization" are used interchangeably. Curing and polymerization are defined as the increase in molecular weight of the modified thermosetting binder such that the modified thermosetting binder forms a network and is no longer soluble in an organic solvent.

The abrasive article of the invention comprises:

(a) a plurality of abrasive grains; and (b) at least one binder for the abrasive grains, wherein the binder comprises a cured precursor, wherein the precursor comprises:

(i) optionally an epoxy resin;

(ii) optionally a modifying component selected from the group consisting of modifying components of the general formula:

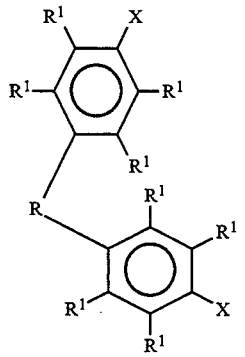

(I)

wherein

X represents an epoxy group;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iii) optionally a modifying component selected from the group consisting of modifying components of the general formula:

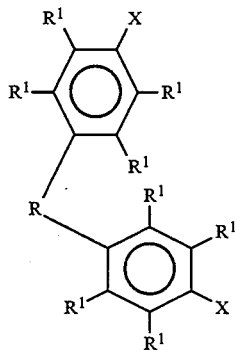

(I)

wherein

X represents —YH;

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds; and (iv) optionally a curing agent, wherein said precursor comprises one of the following combination of components selected from the group consisting of:

(i), (iii) , and (iv);
(i), (ii), (iii), and (iv);
(i), (ii), and (iii);
(i), (ii), and (iv);
(i) and (iii);
(ii), (iii), and (iv);
(ii) and (iii); and
(ii) and (iv);

wherein the epoxy resin of element (b)(i) is defined such that it does not include the modifying component of element (b)(ii), and wherein the curing agent of element (b)(iv) is defined such that it does not include the modifying component of element (b)(iii).

Preferably the precursor comprises a combination of components selected from the group consisting of:

(i), (ii) and (iii);
(i), (ii) and (iv);
(i) and (iii); and
(ii) and (iv).

Most preferably the precursor comprises one of the following combinations of components:

(i), (ii), and (iii); or
(i) and (iii).

The polycyclic aryl, polycyclic alkyl, or cycloalkyl modifying component typically copolymerizes with the precursor thermosetting resin and is covalently connected into the cured thermosetting resin network.

DETAILED DESCRIPTION OF THE INVENTION

Figure 1:
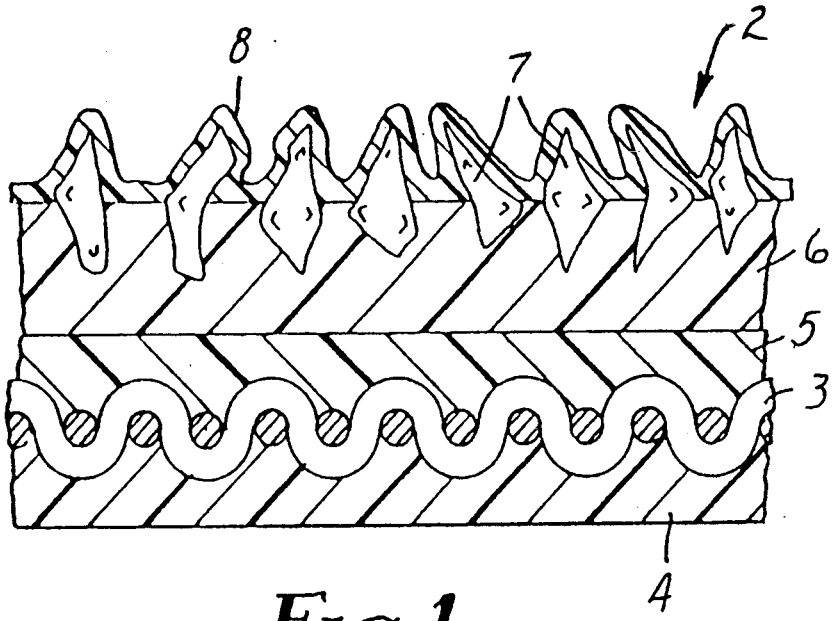
FIG. 1 illustrates in cross section a coated abrasive on a cloth backing.

The term "abrasive articles" as used herein includes bonded abrasive articles, coated abrasive articles, and nonwoven abrasive articles. A coated abrasive article comprising the binder of the invention is illustrated in FIG. 1. As illustrated in FIG. 1, the coated abrasive article generally indicated as 2 is cloth backed. The cloth backing 3 is coated on one side with an optional backsize coat 4 and coated on an opposite side with an optional presize coat 5. Overlaying the presize coat is a make coat 6 in which are embedded abrasive grains 7. A size coat 8 is coated over the make coat 6 and the abrasive grains 7. There is no clear line of demarcation between the backsize coat and the presize coat which meet in the interior of the cloth backing.

(b)(i) Epoxy Resins

The term "epoxy resin" as used herein refers to any organic compound or resin comprising at least one group comprising a three membered oxirane ring, preferably two or more groups comprising a three membered oxirane ring. It is preferred that the epoxy resin comprise a polyepoxide resin in order to obtain an abrasive article having superior performance. A polyepoxide resin refers to any organic compound or resin which comprises, or comprised prior to curing, more than one oxirane ring. Both aromatic and aliphatic polyepoxides may be used, and are well known. It is preferred that the epoxy resin comprise an aromatic polyepoxide due to the superior thermal stability and generally better physical properties obtained therewith. Examples of such aromatic polyepoxides include but are not limited to those selected from the group consisting of the polyglycidyl ethers of polyhydric phenols; glycidyl esters of aromatic carboxylic acids; N-glycidylaminoaromatics such as N-glycidylaminobenzene, N,N,N', N'-tetraglycidyl-4,4'bis-aminophenyl methane, and diglycidylaminobenzene; glycidylamino-glycidyloxyaromatics such as glycidyl-aminoglycidyloxybenzene; and mixtures thereof.

The preferred aromatic polyepoxides for use in the binder precursor according to the invention are the polyglycidyl ethers of polyhydric phenols. The preferred aliphatic epoxides are the diglycidylethers of cylcohexane dimethanol.

Examples of useful polyepoxides include but are not limited to those selected from the group consisting of vinyl cyclohexene dioxide; epoxidized mono-, di- and triglycerides; butadiene dioxide; 1,4-bis(2,3-epoxypropoxy)benzene; 1,3-bis(2,3-epoxypropoxy)benzene; 4,4'-bis(2,3-epoxypropoxy)diphenyl ether; 1,8-bis(2,3-epoxypropoxy)octane; 1,4-bis(2,3-epoxypropoxy)cyclohexane; 4,4'(2-hydroxy-3,4-epoxybutoxy)diphenyl dimethyl methane; 1,3-bis(4,5-epoxypentoxy)-5-chlorobenzene; 1,4-bis(3,4-epoxybutoxy)-2-chlorocyclohexane; diglycidyl thioether; diglycidyl ether; 1,2,5,6-diepoxy-hexane-3; 1,2,5,6-diepoxyhexane; and mixtures thereof. Other usable epoxides are found in Handbook of Epoxy Resin, Lee and Neville, McGraw-Hill, New York (1967) and U.S. Pat. No. 3,018,262 both incorporated herein by reference. Other useful epoxides are listed in U.S. Pat. No. 3,298,998, incorporated herein by reference. These compounds include but are not limited to those selected from the group consisting of bis[p-(2,3-epoxypropoxy)phenyl]cyclohexane; 2,2-bis[p-(2,3-epoxypropoxy)phenyl]norcamphane; 5,5-bis[(2,3-epoxypropoxy)phenyl]hexahydro-4,6-methanoindane; 2,2-bis[4-(2,3-epoxypropoxy)-3-methylphenyl]hexahydro-4,7-methanoindane; and 2-bis[p-2,3-epoxypropoxy)-phenyl]-methylene-3-methylnorcamphane; and mixtures thereof.

Examples of N-glycidylaminobenzenes suitable for use in the binder precursor of the present invention include but are not limited to those selected from the group consisting of the di- and polyglycidyl derivatives of: benzeneamine; benzene diamines; naphthylenamine; naphthylene diamines; and mixtures thereof. Such compounds include but are not limited to those selected from the group consisting of N,N-diglycidylbenzeneamine; N,N-diglycidylnaphthalenamine; 1,4-bis(N-glycidylamino)benzene; 1,3-bis(N,N-glycidylamino)-benzene; and mixtures thereof. The polyglycidyl derivatives of aromatic aminophenols are described in U.S. Pat. No. 2,951,825, incorporated herein by reference. An example of such is N,N-diglycidyl-4-glycidyloxybenzeneamine.

Modifying Components (b) (ii) and (b) (iii)

The (b) (ii) and (b) (iii) modifying components each comprise a cyclic or polycyclic hydrocarbon having at least two pendant phenyl groups, wherein the modifying components have the general formula:

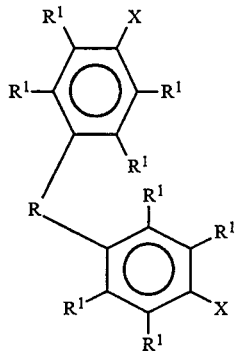

(I)

wherein

X represents a monovalent moiety selected from the group consisting of an epoxy group [in the case of the (b)(ii) modifying component]and —YH [in the case of the (b)(iii) modifying component];

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds (i.e., by "substantially inert" it is meant that $R^1$ is a group which will not react with an epoxy group nor interfere with epoxy polymerization). $R^1$ is preferably independently selected from the group consisting of hydrogen, phenyl, the halogens, and linear and branched alkyl groups comprising 1 to 6 carbon atoms.

Each cyclic structure or ring of R will comprise 3 to 6 carbon atoms. If R comprises one cyclic structure or ring, R is referred to as a cyclic group. If R comprises more than one cyclic structure or ring, R is referred to as a polycyclic group. It is also within the scope of this invention that there be substituents pendant from the cyclic structure(s) or ring(s) of R. These substituents can be any organic group so long as they do not interfere with the polymerization of the precursor composition. Examples of suitable substituents include but are not limited to those independently selected from the group consisting of hydrogen and other groups substantially inert to the polymerization of epoxy group containing compounds. The substituents are preferably independently selected from the group consisting of hydrogen, phenyl, the halogens (F, Cl, Br and I), and linear and branched alkyl groups comprising 1 to 6 carbon atoms.

The modifying component(s) are capable of reacting with the other components of the precursor composition to form a polymer network having pendant groups selected from the group consisting of pendant polycyclic aryls, cyclic alkyls, polycyclic alkyls, and mixtures thereof. The modifying component (b)(ii) of Formula I contains pendant epoxy groups that can copolymerize with conventional epoxy resin (b)(i) and/or react with curing agent (b)(iv) and/or modifying component (b)(iii) each which may optionally be present in the precursor. The modifying component (b)(iii) of Formula I contains pendant reactive substituents that will react with an epoxy group of epoxy resin (b)(i) and/or modifying component (b)(ii) via a nucleophilic substitution reaction and thus serve to cure the epoxy containing materials.

Examples of specific modifying components which fall within the category (b)(ii) or (b)(iii) depending upon the nature of X include but are not limited to those selected from the group consisting of:

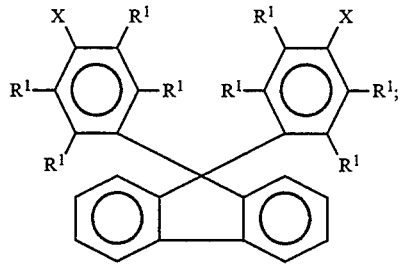

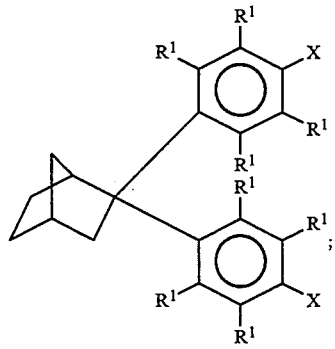

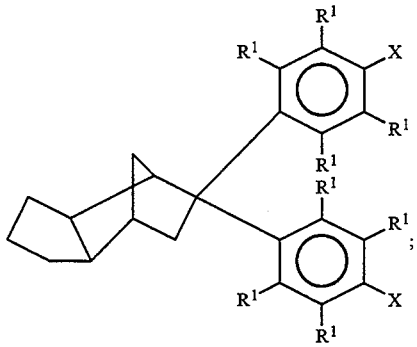

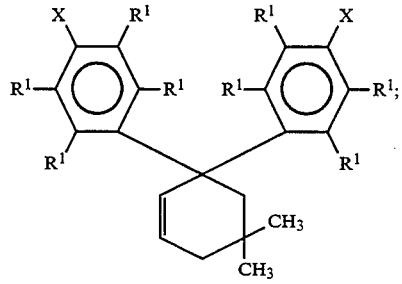

-continued

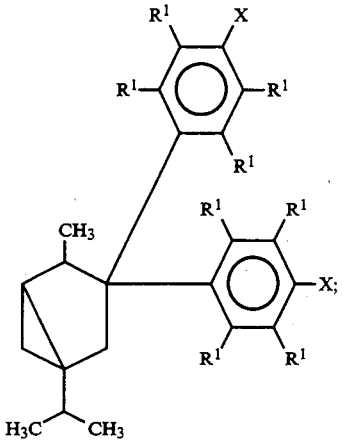

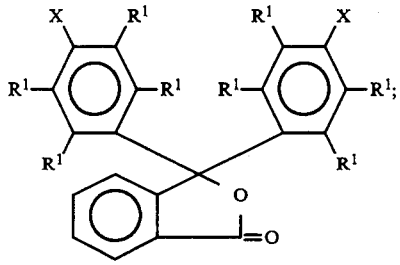

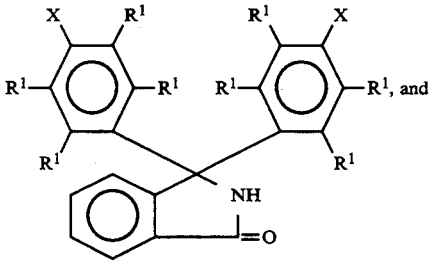

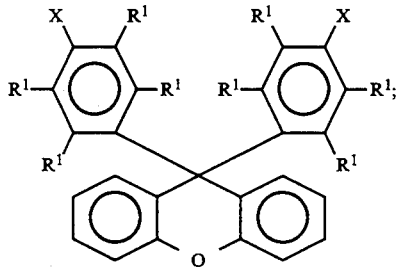

wherein X and $R^1$ are as previously defined; Q is selected from the group consisting of $CR^3_2$, CO, S, SO, $SO_2$, O, and $NR^3$; wherein $R^3$ is independently selected from the group consisting of H and alkyl groups comprising 1 to 4 carbon atoms. It is theorized that the presence of the polycyclic aryl, cyclic alkyl, and/or polycyclic alkyl groups(s) pendant from the resultant polymer network backbone increases the glass transition temperature of the cured binder. Typically, the glass transition temperatures of binders which contain thermosetting resins are increased by increasing the crosslink density of the thermosetting resin. However, this typically leads to a decrease in toughness. It is theorized that the presence of the phenyl groups pendant from a cyclic or polycyclic hydrocarbon modifying component does not significantly increase the crosslink density, while still increasing the glass transition temperature thus leading to a tougher cured resin.

The modifying components (b)(ii) and (b)(iii) each preferably contain a fluorene moiety. Fluorene has the chemical structure:

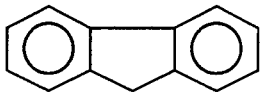

(II)

Fluorene Containing Modifying Component (b)(ii)

The fluorene containing modifying component (b)(ii) is of the general Formula III illustrated below:

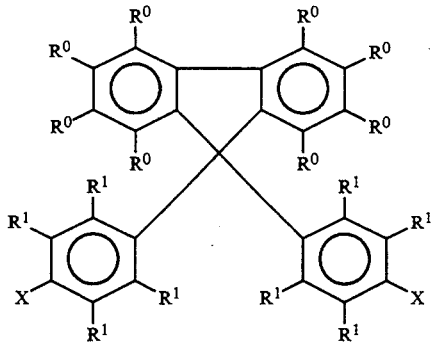

(III)

wherein each $R^0$ is independently selected from the group consisting of hydrogen and other groups substantially inert to the polymerization of epoxy group containing compounds, X comprises an epoxy group, and $R^1$ is as previously defined. Each $R^0$ is preferably independently selected from the group consisting of hydrogen (H), the halogens (F, Cl, Br and I), linear and branched alkyl groups comprising 1 to 6 carbon atoms, phenyl groups, nitro groups, acetyl groups, and trimethylsilyl groups. When it is said that $R^0$ and $R^1$ are "independently" selected, it is meant that there is no requirement that all $R^0$ be the same, or that all $R^1$ be the same. Structures of Formula III are further described in U.S. Pat. No. 4,983,672 incorporated hereinafter by reference.

A preferred example of such a fluorene containing modifying component is the glycidyl ether of bis 9,9-(4-hydroxyphenyl)fluorene. This (b)(ii) modifying component can be used as the sole epoxy component in the abrasive binder or it can be used in a mixture with conventional (b)(i) epoxy resins as the epoxy component of the abrasive binder. When the binder is cured, the glycidyl ether of bis-(4-hydroxyphenyl)fluorene reacts with conventional (b)(i) epoxy resin that may be present or with epoxy curing agents (b)(iv) that are present and become covalently bound into the cured epoxy resin network as illustrated below in structure IV:

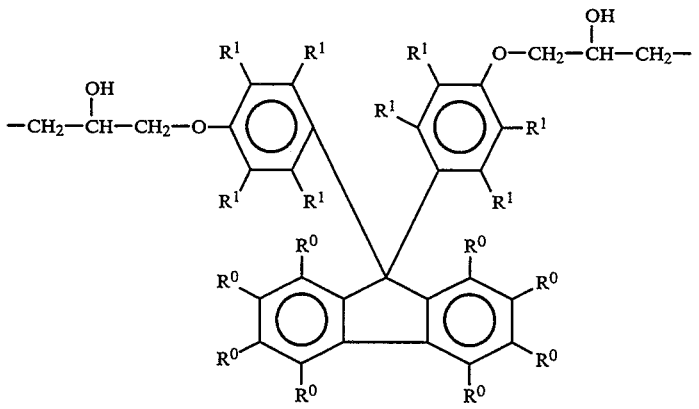

(IV)

Fluorene Containing Modifying Component (b)(iii)

The chemical structure of a fluorene containing modifying component (b)(iii) having an epoxy reactive substituent is illustrated below by structure V:

(V)

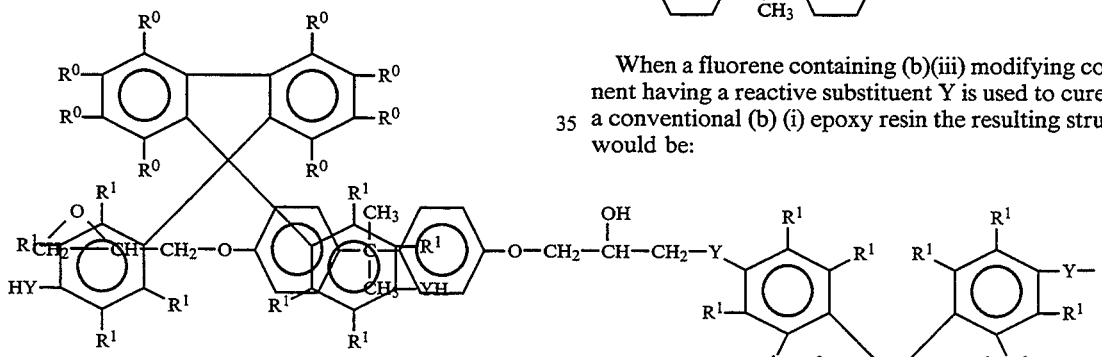

wherein Y, $R^1$ and $R^0$ are as previously defined.

The Y group is one that will react with an epoxy resin via a nucleophilic addition reaction to form a cured epoxy resin. The —YH group would typically comprise a substituent selected from the group consisting of primary amine, secondary amine, hydroxy, mercapto, and carboxylic acid groups.

An example of a fluorene containing (b)(iii) modifying component is 9,9-bis(aminophenyl) fluorene which is described in U.S. Pat. No. 4,684,678, incorporated by reference herein. U.S. Pat. Nos. 4,983,672 and 5,045,363, both incorporated by reference herein, describe other specific examples of compounds useful as (b)(iii) modifying components.

A typical (b)(i) epoxy resin useful in the present invention is 2,2-bis-[4-(2,3-epoxypropoxy)phenyl]propane which is illustrated below:

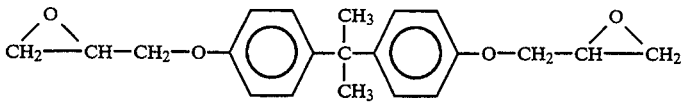

(VI)

When a fluorene containing (b)(iii) modifying component having a reactive substituent Y is used to cure such a conventional (b) (i) epoxy resin the resulting structure would be:

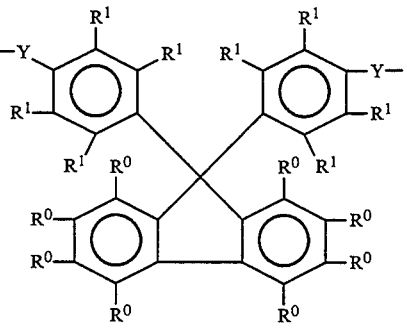

(VII)

wherein $R^0$, $R^1$ and Y are as previously defined.

(b)(iv) Curing Agents

The precursor used according to the present invention can optionally comprise a conventional (b)(iv) curing agent (i.e., one that differs from the modifying component (b)(iii) which itself is capable of facilitating cure of the precursor composition). The terms "curing agent" and "catalyst" are used interchangeably herein. The term "curing agent" as used herein refers to a material capable of initiating the homopolymerization of an epoxy resin into a cured network or capable of undergoing addition polymerization with an epoxy resin in order to form a cured network.

The (b)(iv) curing agents suitable for use in the binder precursor of the present invention include those conventionally used for curing epoxy resin compositions and forming cross-linked polymer networks. Typically, the curing agents are acidic or alkaline. Such curing agents include but are not limited to those selected from the group consisting of aliphatic and aromatic primary amines, such as di(4-aminophenyl)-sulfone; di-(4-aminophenyl)ether; and 2,2-bis(4-aminophenyl)propane; and aliphatic and aromatic tertiary amines such as dimethylpropylamine and pyridine; which may act as curing agents to generate substantial crosslinking.

Other useful curing agents include but are not limited to those selected from the group consisting of amino-containing compounds, such as, for example, diethylenetriamine; triethylenetetraamine; dicyandiamide; melamine; pyridine; cyclohexylamine; benzyldimethylamine; benzylamine; diethylaniline; triethanolamine; piperidine; tetramethylpiperamine; N,N-dibutyl-1,3-propane diamine; N,N-diethyl-1,3-propane diamine; 1,2-diamino-2-methyl-propane; 2,3-diamino-2-methylbutane; 2,3-diamino-2-methyl-pentane; 2,4-diamino-2,6-dimethyloctane; dibutylamine dioctylamine; and especially the aromatic polyamines: o-phenylene diamine; 4,4-diaminodiphenyl sulfone; 3,3'-diaminodiphenyl sulfone; 4,4'-diaminodiphenylsulfide; 4,4'-diaminodiphenyl ketone; 4,4'-diaminodiphenyl ether; 4,4'-diaminodiphenyl methane; 1,3-propanediol-bis(4-aminobenzoate); ortho, meta, and para 1,4-bis(alpha-4-aminophenyl)-alphamethylethyllbenzene; 1,4-bis(alpha-4-amino-3,5-dimethylphenyl)-alpha-methylethylbenzene; bis (4-amino-3-methylphenyl)sulfone; 1,1'-biphenyl-3,3'-dimethyl-4,4'-diamine; 1,1'-biphenyl-3,3'-dimethoxy-4,4'-diamine; diaminonapthalenes; and mixtures thereof.

Also useful are those curing agents selected from the group consisting of Lewis acids such as aluminum trichloride; aluminum tribromide; boron trifluoride; antimony pentafluoride; titanium tetrafluoride; and the like. It is also within the scope of this invention to use those curing agents selected from the group consisting of onium and sulfonium curing agents such as those described in U.S. Pat. Nos. 4,026,705; 4,032,673; 4,069,054; 4,136,102; and 4,173,476; all of which are incorporated herein after by reference. Also useful are those curing agents selected from the group consisting of boron trifluoride complexes such as $BF_3$/diethylamine, imidazoles such as 2-ethyl-4-methylimidazole, hydrazides such as aminodihydrazide; guanidines such as tetramethyl guanidine; and dicyandiamide.

Examples of other suitable curing agents include those selected from the group consisting of the polybasic acids and their anhydrides, such as the di-, tri-, and higher carboxylic acids such as oxalic acid; phthalic acid; terephthalic acid; succinic acid; alkyl and alkenyl substituted succinic acids; tartaric acid; and the polymerized unsaturated acids, such as for example, those comprising at least 10 carbon atoms, as for instance, dodecendioic acid; and anhydrides such as maleic anhydride; nadic anhydride; pyromelitic dianhydride; and the like. Generally, from about 0.5 to about 2 equivalents of acid or anhydride are used per equivalent of epoxy group present in the precursor composition. With the anhydrides, an optional accelerator, in the range of about 0.1 to about 5 percent by weight of the precursor composition may be present, e.g., an aromatic tertiary amine such as benzyldimethyl amine.

The amount of curing agent needed will vary depending upon the (b)(i) epoxy resin and/or (b)(ii) epoxy functional modifying component selected and is generally to be provided in such an amount as to be effective in causing substantially complete curing within a desired length of time. A typical binder precursor will comprise from about 1 to about 50 percent by weight, preferably from about 1 to about 30 percent by weight (b)(iv) curing agent, if used, based on the total weight of the binder precursor. It will be understood that the final properties of the cured binder precursor will be greatly influenced by the relative amounts of (b)(iv) curing agent and the (b)(i) epoxy resin and/or (b)(ii) epoxy functional modifying component.

The preferred and most preferred ranges in weight percent for the precursor composition components are listed below in Table A, wherein the percentages for each component are based on the total weight of the precursor composition.

TABLE A

| Precursor Composition | (i)[1] | (ii)[2] | (iii)[3] | (iv)[4] |
|---|---|---|---|---|
| | | Preferred Ranges* | | |
| (ii)(iv) | | 99 to 60 | | 1 to 40 |
| (ii)(iii) | | 90 to 50 | 10 to 50 | |
| (ii)(iii)(iv) | | 99 to 60 | 10 to 50 | 1 to 40 |
| (i)(iii) | 90 to 50 | | 10 to 50 | |
| (i)(iii)(iv) | 90 to 50 | | 10 to 50 | 1 to 40 |
| (i)(ii)(iii) | 90 to 5 | 90 to 5 | 10 to 50 | |
| (i)(ii)(iii)(iv) | 90 to 10 | 95 to 10 | 10 to 50 | 1 to 40 |
| (i)(ii)(iv) | 90 to 5 | 90 to 5 | | 1 to 40 |
| | | Most Preferred Ranges* | | |
| (ii)(iv) | | 95 to 70 | | 5 to 30 |
| (ii)(iii) | | 75 to 50 | 25 to 50 | |
| (ii)(iii)(iv) | | 75 to 50 | 25 to 50 | 1 to 20 |
| (i)(iii) | 85 to 50 | | 15 to 50 | |
| (i)(iii)(iv) | 85 to 50 | | 15 to 50 | 1 to 20 |
| (i)(ii)(iii) | 75 to 10 | 75 to 10 | 25 to 50 | |
| (i)(ii)(iii)(iv) | 75 to 10 | 75 to 10 | 15 to 50 | 1 to 20 |
| (i)(ii)(iv) | 75 to 10 | 75 to 10 | | 1 to 20 |

[1]epoxy resin
[2]modifying component having at least one pendant epoxy group
[3]modifying component having at least one epoxy reactive substituent
[4]curing agent
*The ranges should be read such that the term "about" is inserted before each numerical value

Optional Components

The binder precursor preferably further comprises up to about 30 percent by weight of a toughening agent. The binder precursor typically comprises about 2 to about 30 percent by weight of a toughening agent, if used, preferably about 4 to about 20 percent by weight, most preferably about 5 to about 15 percent by weight, based upon the total weight of the precursor composition. Useful toughening agents include but are not limited to those selected from the group consisting of elastomeric polymers, elastomeric oligomers, and mixtures thereof. Examples of additional toughening agents include those disclosed in U.S. Pat. No. 4,684,678, incorporated by reference herein. Examples of useful toughening agents include but are not limited to those selected from the group consisting of carboxylated acrylonitrile/butadiene vulcanizable elastomer precursors, isocyanate-functional polyethers, and functional acrylic rubbers including acrylic core/shell materials and core/shell polymers such as methacrylate-butadiene copolymers.

The binder precursor may also further comprise about 0 to about 30 percent by weight of a solvent, typically about 0.1 to about 30 percent by weight, if used, based upon the total weight of the binder precursor in order to lower the viscosity of the binder precursor in order to make it easier to process. Examples of suitable solvents include but are not limited to those selected from the group consisting of water and organic solvents such as esters (e.g. esters of carboxylic acids and $C_1$ to $C_6$ alcohols such as ethyl acetate, butyl acetate, dichloroethane, etc.).

The binder precursor can optionally further comprise other additives that are commonly used in abrasive articles. These optional additives include but are not limited to those selected from the group consisting of fillers, fibers, lubricants, grinding aids, wetting agents, surfactants, pigments, dyes, coupling agents, plasticizers, thermoplastics such as polyetherimides, suspending agents, and mixtures thereof. The amounts of these additives are selected to yield an abrasive article having the desired abrasive properties. It is preferred to add a filler and/or grinding aid to the binder precursor. Fillers and grinding aids are both typically inorganic particles having particle sizes ranging from about 1 to about 50 micrometers. The fillers can be selected from any filler material which does not adversely affect the characteristics of the cured precursor. Examples of preferred fillers include but are not limited to those selected from the group consisting of calcium carbonate, silica, calcium metasilicate, and mixtures thereof. Examples of preferred grinding aids include but are not limited to those selected from the group consisting of cryolite, potassium tetrafluoroborate, and mixtures thereof. The weight ratio of the binder precursor to the combined weight of the filler and/or grinding aid will range from about 20 to about 80 parts by weight binder precursor to about 80 to about 20 parts by weight total filler and/or grinding aid.

During the manufacture of an abrasive article, the binder precursor is exposed to an energy source to initiate the polymerization or curing of the binder precursor. This energy source can be thermal, i.e., heat or radiation energy e.g., electron beam, ultraviolet light or visible light, microwave radiation. Thermal energy is the preferred energy source. For coated abrasive articles and nonwoven abrasive articles, the curing temperature is limited to the temperature that the backing or the fibrous nonwoven substrate can withstand. For example if the backing contains polyester fibers, the curing temperature will be limited to less than about 200° C.; likewise if the backing contains aramid fibers the curing temperature will be limited to about 300° C. For a metal backing, the curing temperature can be about 250° C. or greater. The rate of curing with any energy source varies with the nature of composition. Typical curing conditions involve heating the binder precursor for about 15 minutes to about 4 hours at about 150° C. to about 200° C.

In the manufacture of a coated abrasive product, the binder precursor of this invention can be used as either a backsize coat, a saturant coat, a presize coat, a make coat, a size coat, a supersize coat, or combinations thereof. If the thermosetting binder precursor of the invention is not employed in all of these coats, then a conventional binder can be employed. Examples of conventional binder resins include but are not limited to those selected from the group consisting of phenolic resins, urea-formaldehyde resins, melamine formaldehyde resins, latices, urethane resins, aminoplast resins, acrylate resins, epoxy resins, isocyanate resins, and mixtures thereof. The binder precursor of the invention can also be blended with such conventional resins.

In the manufacture of a nonwoven abrasive, the abrasive grains are first dispersed in a make coat precursor to form an abrasive slurry. The abrasive slurry is applied by spraying into an open porous lofty nonwoven substrate by any conventional coating technique. Next, the make coat precursor is polymerized to form the make coat. Nonwoven abrasive products in general are illustrated in U.S. Pat. No. 2,958,593 incorporated herein by reference.

The binder of this invention can also be used in bonded abrasive products. The modified thermosetting binder serves to bond abrasive grains together to form a shaped mass. The shaped mass is preferably in the form of a grinding wheel. Bonded abrasive products are typically manufactured by a molding process, which process is well known to those skilled in the art.

Concurrently filed U.S. application Ser. No. 07/845,016 (Attorney's Docket Number 46944USA1A), now abandoned, entitled Abrasive Product Having A Binder Comprising A Maleimide Binder, incorporated by reference herein, discloses flexible abrasive articles which have improved performance under dry and wet grinding condition and at high temperatures, which uses the binder of the present invention in certain applications such as a saturant coat in an abrasive article. The invention in the application relates to an abrasive article wherein either a make, size, supersize, saturant, presize, and/or a backsize coat comprises a maleimide binder.

The following non-limiting examples will further illustrate the invention. All parts, percentages, ratios, etc. in the examples and the rest of the specification are by weight unless otherwise indicated.

The following abbreviations and trade names are used throughout.

CMS—a calcium metasilicate filler which containing amino silane coupling agent commercially available as Wollastokup TM filler from the Nyco Company.

CAO—a ceramic aluminum oxide abrasive grain made according to U.S. Pat. Nos. 4,744,802 and 5,011,508, both incorporated by reference herein, consisting of 93.5% alpha alumina by weight, 4.5% MgO, and 2% iron oxide.

CAO[2]—ceramic $Al_2O_3$ described in U.S. Pat. Nos. 4,964,883; 5,011,508; and 4,744,802; all incorporated by reference herein, consisting of 99% alpha aluminum and 1% iron oxide.

ER1—an epoxy resin, commercially available from the Dow Chemical Company under the trade designation "DER 332".

PEI—a polyetherimide commercially available from General Electric under the trade designation "Ultem 1000".

SOL—a nonplar organic solvent having the trade designation "Aromatic 10011", commercially available from Worum Chemical Co., St. Paul, Minn.

HPT 1079—a fluorene containing epoxy resin commercially available from Shell Chemical Company.

Modifying Component A—a fluorene containing modifying component which is illustrated in Structure VIII.

(VIII)

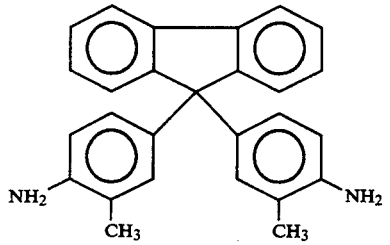

Modifying Component B—a fluorene containing modifying component which is illustrated in Structure IX.

(IX)

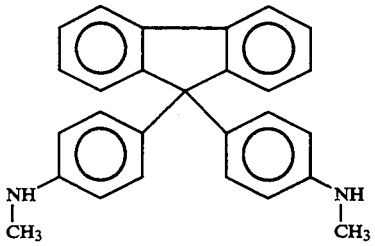

Modifying Component C—a fluorene containing modifying component which is illustrated in Structure X.

(X)

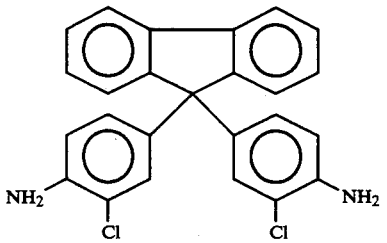

Modifying Components A, B and C can be prepared according to the methods disclosed in U.S. Pat. No. 4,684,678, incorporated by reference herein.

Preparation of Modifying Component A

Into a 500 ml pressure vessel the following ingredients were placed:

18.0 g fluorenone
107.0 g 2-methylaniline
5.6 methanesulfonic acid

The vessel was sealed and heated to 175° C. for 24 hours. The water formed in the condensation reaction was retained in the vessel throughout the reaction. The vessel was cooled and its contents poured into 1 liter of methanol containing twenty grams of triethyl amine. The white crystalline product was filtered and washed with methanol until the effluent was colorless. 32 grams of a crystalline compound melting at 228° to 230° C. was recovered and identified by NMR spectroscopy analysis as 9,9-bis(3-methyl-4-aminophenyl)fluorene.

This product was designated as Modifying Component A.

Preparation of Modifying Component B

Into a 500 ml 3-necked flask equipped with a Dean-Stark trap and means for flooding with nitrogen were placed:

22.5 g fluorene
94.0 g N-methylaniline
18.0 g concentrated hydrochloric acid.

A stream of nitrogen was introduced and the flask and its contents heated to 140° C. These conditions were maintained for 8 hours during which time water and condensate that collected in the Dean-Stark trap were removed.

The reaction mixture was then cooled to 90° C. and poured into a solution of 19 g triethyl amine in 350 g ethanol. The solution that was obtained was cooled to 10° C., and held at this temperature for 16 hours. The white crystals which formed were filtered off and washed with cold ethanol until the effluent was colorless. The white crystals obtained were vacuum dried at 100° C. for 16 hours. There was obtained 35 g of pure white crystals melting at 200° to 201° C. Analysis by NMR spectroscopy indicated that the crystals were bis(4-methylaminophenyl)fluorene.

Preparation of Modifying Component C

Into a 500 ml pressure vessel the following ingredients were placed:

20.0 g fluorenone
142.5 g 2-chloroaniline
5.3 g methanesulfonic acid.

The vessel was sealed and heated to 175° C. for 24 hours. The water formed in the condensation reaction was retained in the vessel throughout the reaction. The vessel was cooled and its contents poured into 1 liter of methanol containing twenty grams of triethyl amine. The white crystalline product was filtered and washed with methanol until the effluent was colorless. There was obtained 37.6 grams of a white powder melting at 198° to 200° C. Analysis by NMR spectroscopy indicated that the crystals were Component C.

Procedure I for Making the Coated Abrasive

A make coat, comprising 48% of a resole phenolic resin and 52% of CMS, was prepared. The make coat was diluted to 84% solids with a 90/10 solvent blend of water/ethylene glycol monobutyl ether acetate and applied to the front side of the selected backing with a wet weight of 220 g/m$^2$. Into the make coat was electrostatically coated 480 g/m$^2$ of grade 50 CAO. The resulting product was heated for 90 minutes at 90° C. Next, a size coat was applied over the abrasive grains/-make coat with a wet weight of 390 g/m$^2$. The formulation of the size coat was the same as the make coat, except that the percent solids was 78%. The resulting product was heated for 90 minutes at 90° C., following which it was heated at 10 hours at 100° C. After curing, the coated abrasive product was flexed prior to testing.

Procedure II for Making the Coated Abrasive

A make coat comprising 33.1% of a bismaleimide resin (Compimide TM 796 commercially available from the Shell Chemical Co., Houston, Tex.), 14.9% of a bismaleimide curing agent (Compimide TM 121 commercially available from the Shell Chemical Co., Houston, Tex.) and 52% of CMS was prepared. The make coat was diluted with N-methyl pyrrolidone to 82% solids and was applied to the front side of the selected backing with a wet weight of 220 g/m$^2$. Into the make coat was electrostatically coated 480 g/m$^2$ of grade 50 CAO. The resulting product was heated for one hour at 120° C., one hour at 140° C., and 2 hours at 180° C.

Next, a size coat was applied over the abrasive grains/make coat with a wet weight of 390 g/m$^2$. The formulation of the size coat was the same as the make coat, except that the size coat was 78% solids. The resulting product was heated for one hour at 120° C., one hour at 140° C., one hour 190° C., followed by 14 hours at 220° C. in a vacuum oven. After curing, the coated abrasive product was flexed prior to testing.

Test Procedure I

The coated abrasive material was attached to the periphery of a 36 cm diameter metal wheel, which rotated to produce a surface speed of 1677 meters/minute. The effective cutting area of the abrasive segment was 2.54 cm by 109 cm. The workpiece consisted of three identical 1018 steel bars (plain carbon steel containing 0.18% carbon) measuring 1.27 cm wide by 36 cm long by 7.6 cm high positioned parallel to one another and separated by 1.27 cm wide gaps. Abrading was carried out on the 1.27 cm by 36 cm faces of the three steel bars. The workpiece was mounted on a reciprocating table which traversed at 18 meters/minute. At the end of each table stroke, the metal wheel was moved 1.27 cm perpendicular to the motion of the reciprocating table. This indexing of the wheel position was continued in the same direction until the abrasive material moved beyond the outside metal bar at which time the direction was reversed. On each direction reversal of this sideways wheel motion, the wheel was down fed 45.7 micrometers. This abrading process was conventional surface grinding wherein the workpiece was reciprocated beneath the rotating contact wheel with an incremental down feed taking place at either end of the grinding wheel cross feed cycle. The test endpoint was reached when all of the usable abrasive grains had been worn away from the surface of the coated abrasive. The amount of steel removed in each example was measured in grams. The grinding was carried out under a water flood. Prior to testing, all Of the examples were soaked for 16 hours in 98° C. hot water. Average values of two or more tests are reported.

Test Procedure II

Test Procedure II was essentially the same as Test Procedure I, except that there was no water soak in 98° C. hot water prior to testing.

Test Procedure III

Test Procedure III was essentially the same as Test Procedure II except a downfeed of 61.0 micrometers was used.

Comparative Examples A and B, Examples 1 and 2

This set of examples compares various coated abrasive constructions comprising the thermosetting binder of the invention with those comprising conventional binders. The resulting coated abrasives were tested according to Test Procedure I and the results can be found in Table 1.

Comparative Example A

The coated abrasive for Comparative Example A was made according to "Procedure I for Making the Coated Abrasive" except for the treatment of the backing prior to receiving the make coat. In this example the backing was a Y weight (285 g/m$^2$) woven polyester backing having a four over one weave. The backing was saturated with a latex/phenolic resin and then placed in an oven to partially cure the resin. Next, a backsize coat was applied to the backside of the backing and then heated to partially cure the resin. The backsize coat comprised a latex/phenolic resin/calcium carbonate solution. Finally, a latex/phenolic resin was applied to the front side of the backing and heated to partially cure the resin. The backing was completely treated and was ready to receive the make coat.

Comparative Example B

The coated abrasive for Comparative Example B was made according to "Procedure I for Making the Coated Abrasive". In this example the backing was the same as Comparative Example A except that the backing contained a second backsize coat applied over the first backsize coat. The second backsize coat comprised 60% of a bisphenol A based epoxy resin (Epon 828 commercially available from the Shell Chemical Co., Houston, Tex.) and 40% of a polyamide curing agent (Versamid 125 commercially available from the Henkel Corp.). The second backsize coat was diluted with SOL to 50% solids prior to coating. The second backsize coat was applied with a coating wet weight of 78 g/m$^2$ and the cloth was heated for 2 hours at 90° C. to cure the epoxy resin.

EXAMPLE 1

The coated abrasive for Example 1 was made according to "Procedure I for Making the Coated Abrasive". In this example a greige cloth backing having a two over one weave of a 1000 denier aramid fiber in the warp direction, a 445 denier texturized polyester yarn in the fill direction, and a 38 by 27 thread count was used. The aramid fiber was purchased from Teijin Corporation under the trade designation Technora. A cloth treating solution was prepared that comprised 35 g of ER1, 65 g of HPT 1079, 21.6 g of Modifying Component A, 47.6 g of Modifying Component B, 5.1 g of an epoxy functional silicone glycol (X2-8419 commercially available from Dow Corning) and 5.1 g of a powdered silicone rubber (X5-8406 commercially available from Dow Corning). The above cloth treating solution was diluted to 79% solids with a 50/50 blend of butyl acetate and ethylene glycol monobutyl ether acetate. The greige cloth was saturated with the cloth treating solution with a wet weight of 220 g/m$^2$. The resulting cloth was heated for 20 minutes as the temperature increased from room temperature to 150° C. and then heated for 20 minutes at 150° C. Next, the cloth was presized via a knife coater by applying the cloth treating solution over the front side of the cloth with a wet weight of 160 g/m$^2$. The resulting cloth was heated for 15 minutes as the temperature was increased from room temperature to 150° C. and then heated for 5 minutes at 150° C. In a final step, after the coated abrasive product was made according to Procedure I, it received an additional one hour thermal cure at 180° C.

EXAMPLE 2

The coated abrasive for Example 2 was made according to "Procedure II for Making the Coated Abrasive" but using the backing of Example 1.

TABLE 1

| Example | Test Procedure I Total Steel Removed (g) | Test Procedure III Total Steel Removed (g) |
|---|---|---|
| Comparative A | 747 | 711 |
| Comparative B | 1133 | 1492 |
| 1 | 1630 | 930 |
| 2 | 2636 | 1272 |

The data contained in Table 1 demonstrates that the modified binder of the invention exhibits excellent water resistant properties when employed in a coated abrasive backing.

Comparative Example A and Example 3

This set of examples demonstrated the use of a cured epoxy resin modified with a fluorene containing modifying component in the make and size coats of a coated abrasive article of the invention. The coated abrasive articles of Comparative Example A and Example 3 were tested according to Test Procedure I and the results can be found in Table 2.

EXAMPLE 3

The coated abrasive for Example 3 was made according to the following procedure. The backing consisted of a greige cloth which had a two over one weave of a 20 denier aramid fiber in the warp and fill directions. The thread count was 100 by 52. This backing was purchased from Teijin under the style number MS0221. A cloth treating solution was prepared that comprised 25% PEI and 75% N-methyl pyrrolidione. The greige cloth was saturated with this cloth treating solution with a wet weight of 217 g/m$^2$ and then heated for two hours at 120° C. Next, the resulting cloth was presized with the same cloth treating solution using a knife coater with a wet weight of 140 g/m$^2$. The article was heated for one hour at 120° C., followed by 2 hours at 150° C. Make and size coats were prepared that comprised 48% of a resinous composition and 52% of CMS. The resinous composition comprised 35 parts ER1, 65 parts HPT 1079, 21.6 parts Modifying Component A, and 47.6 parts Modifying Component B. The make coat was diluted to 81% solids with ethylene glycol monobutyl ether acetate. The make coat was applied to the backing with a wet weight of 220 g/m$^2$ following which 480 g/m$^2$ of grade 50 CAO was electrostatically coated into the make coat. The resulting construction was heated for one hour at 100° C., followed by gradually increasing the temperature to 150° C. over 15 minutes and then an additional 15 minutes at 150° C. A size coat was roll coated over the abrasive grains with a wet weight of 370 g/m$^2$. The size coat was the same as the make coat except the percent solids was 78%. The resulting construction was heated for 1 hour at 120° C. followed by one hour at 180° C.

TABLE 2

| Example | Test Procedure I Total Steel Removed (g) |
|---|---|
| Comparative A | 589 |
| 3 | 283 |

The data contained in Table 2 demonstrates that the modified binder of the invention is useful in a make and size coat of a coated abrasive article.

Comparative Example A and Examples 4 through 6

This set of examples demonstrated the superior grinding performance of the abrasive articles of the invention. The coated abrasive articles of Comparative Example A and Examples 4–6 were tested according to Test Procedure I and the results can be found in Table 3. Additionally, the coated abrasive articles of Comparative Example A and Examples 5 and 6 were tested according to Test Procedure II and the test results can be found in Table 4.

EXAMPLE 4

The coated abrasive article of Example 4 was made according to the following procedure. The backing consisted of a greige cloth which had a two over one weave of a 20 denier aramid fiber in the warp and fill directions. The thread count was 100 by 52. This backing was purchased from Teijin under the style number MS0221. A saturant coat was prepared comprising 35 parts ER1, 65 parts HPT 1079, 57.3 parts PEI, and 72.0 parts Modifying Component A. The saturant coat was diluted with solvent to 71% solids with ethylene glycol monobutyl ether acetate prior to coating. The greige cloth was saturated with this cloth treating solution with a wet weight of 388 g/m$^2$ and then heated for thirty minutes at 100° C., followed by 5 minutes at 150° C. A backsize coat was prepared that consisted of a 25% PEI and 75% N-methyl pyrrolidone. The cloth was then backsized with a wet weight of 200 g/m$^2$ using a knife coater. The backsize cloth was heated for 40 minutes at 100° C., followed by 20 minutes at 120° C., and 5 minutes at 150° C. The remainder of the steps to make the coated abrasive were the same as Example 3 except that the coated abrasive received a size thermal cure of 90 minutes at 88° C., followed by one hour at 100° C., 15 minutes at 150° C., and one hour at 180° C.

EXAMPLE 5

The coated abrasive article of Example 5 was prepared according to "Procedure I for Making the Coated Abrasive" except that a different size coat thermal cure was utilized. The size coat thermal cure was for 90 minutes at 88° C., followed by 10 hours at 100° C., and one hour at 180° C. Additionally the backing for Example 5 was the same treated backing as utilized in Example 4.

EXAMPLE 6

The coated abrasive article of Example 6 was made in the same manner as Example 4 except that different make and size coats were utilized. The make coat consisted of 48% resinous solution and 52% CMS. The resinous solution consisted of 57 parts of a bismaleimide resin (Matrimid 5292A commercially available from Ciba-Geigy) and 43 parts of diallyl bisphenol A (Matrimid 5292B commercially available from Ciba-Geigy). The make coat was diluted to 80% solids with N-methyl pyrrolidone. The make coat was knife coated onto the backing with a wet weight of about 220 g/m$^2$ following which 480 g/m$^2$ of grade 50 CAO was electrostatically coated into the make coat. The resulting product was heated for 1 hour at 100° C., followed by 15 minutes at 150° C., and 30 minutes at 190° C. Next, a size coat, which was identical to the make coat except for having a 76% solids content, was roll coated over the abrasive grains with a wet weight of 450 g/m$^2$. The resulting product was heated for one hour at 120° C., followed by one hour at 150° C., one hour at 190° C., and 14 hours at 220° C. The 220° C. thermal cure was conducted under a vacuum.

TABLE 3

| Test Procedure I | |
|---|---|
| Example | Total Steel Removed (g) |
| Comparative A | 805 |
| 4 | 536 |
| 5 | 1721 |
| 6 | 3777 |

TABLE 4

| Test Procedure II | |
|---|---|
| Example | Total Steel Removed (g) |
| Comparative A | 1899 |
| 5 | 3996 |
| 6 | 6367 |

The data contained in Table 4 demonstrates that even when used without any hot water presoak the fluorene epoxy treated backings provide superior wet grinding performance.

Examples 7 through 9 and Comparative Example C

Comparative Example C

The coated abrasive for this example was made in the same manner as Comparative Example A except that the abrasive grain $CAO^2$ was utilized.

EXAMPLE 7

The coated abrasive fabric for this example was the same as Example 3. A saturant solution was prepared that consisted of 35 parts of ER1, 65 parts of HPT 1079, 97.8 parts of PEI, and 81.7 parts of Modifying Component C. This saturant solution was then diluted to 40% solids with a 90/10 1,2-dichloroethane/butyl acetate diluent. The fabric was saturated with this solution with a wet weight of about 280 g/m$^2$. Then the resulting fabric was heated for 30 minutes at 100° C., followed by 5 minutes at 150° C. Next, the saturated fabric was backsized with a solution that consisted of a 25% solids of PEI in N-methyl pyrollidinone diluent. The wet backsize weight was 64 g/m$^2$. The resulting construction was heated for 40 minutes at 100° C. and then 20 minutes at 120° C. The remaining steps to form the coated abrasive were the same as Comparative Example C except that the coated abrasive received an additional thermal cure of 2 hours at 180° C. prior to testing.

EXAMPLE 8

The coated abrasive for Example 8 was made according to Procedure II for Making the Coated Abrasive except for the following changes. The abrasive grain was $CAO^2$. The backing for Example 8 was the same as that described in Example 7.

EXAMPLE 9

The coated abrasive treated backing for Example 9 was the same as that in 7. The make coat, abrasive grain and size coat were applied in the same manner as Example 6 except the abrasive grain was $CAO^2$.

TABLE 5

| Test Procedure I and II | | |
|---|---|---|
| Example | Test Procedure I Total Steel Removed (g) | Test Procedure II Total Steel Removed (g) |
| Comparative A | 481 | 4078 |
| 7 | 805 | 3838 |
| 8 | 1511 | 5911 |
| 9 | 5352 | 8867 |

The data contained in Table 5 demonstrates that water resistance of the resins becomes even more important when higher performance mineral is used in the coated abrasive.

Various modifications and alterations of this invention will become apparent to those skilled in the art without departing from the scope and spirit of this invention, and should be understood that this invention is not to be unduly limited to the illustrated embodiments set forth herein.

We claim:

1. An abrasive article comprising:

(a) a plurality of abrasive grains; and (b) at least one binder for the abrasive grains, wherein the binder comprises a cured precursor, wherein the precursor comprises:

(i) optionally an epoxy resin;

(ii) optionally a modifying component selected from the group consisting of modifying components of the general formula:

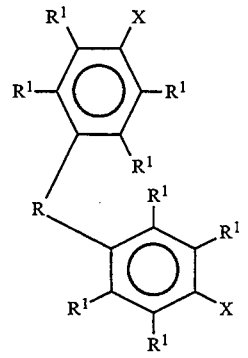

(I)

wherein

X represents an epoxy group;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iii) optionally a modifying component selected from the group consisting of the general formula:

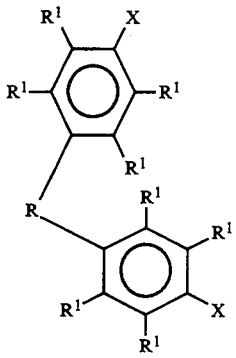

(I)

wherein

X represents —YH;

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iv) optionally a curing agent, wherein said precursor comprises one of the following combination of components selected from the group consisting of:

(i), (iii), and (iv);

(i), (ii), (iii), and (iv);

(i), (ii), and (iii);

(i), (ii), and (iv);

(i) and (iii);

(ii), (iii), and (iv);

(ii) and (iii); and (ii) and (iv);

wherein the epoxy resin of element (b)(i) is defined such that it does not include the modifying component of element (b)(ii), and wherein the curing agent of element (b)(iv) is defined such that it does not include the modifying component of element (b)(iii).

2. The abrasive article of claim 1 wherein the (b)(ii) modifying component is selected from the group consisting of:

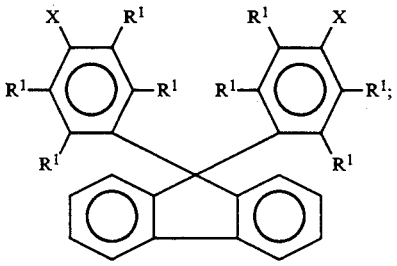

-continued

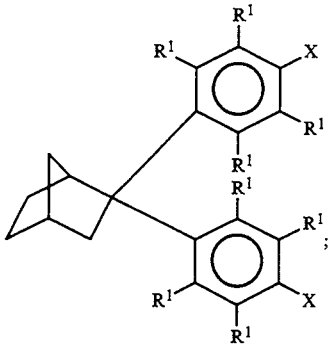

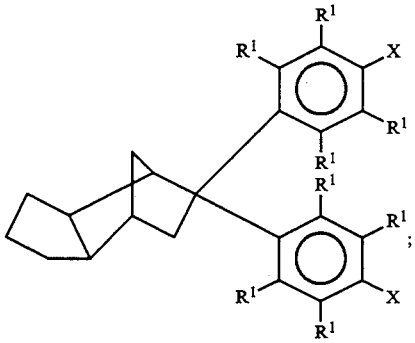

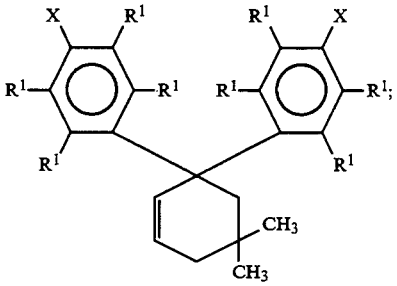

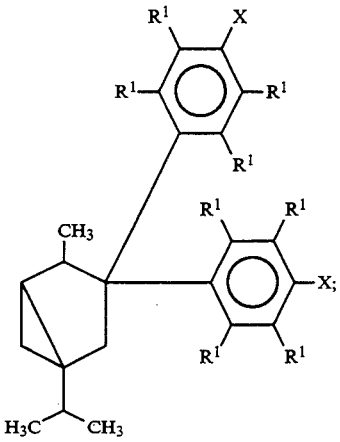

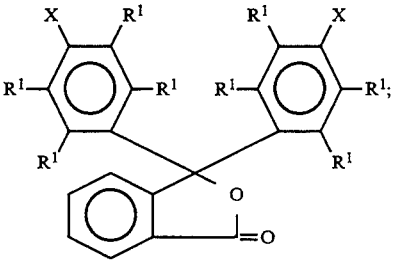

-continued

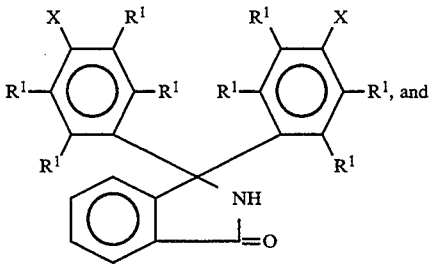

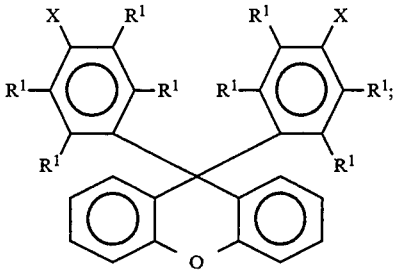

wherein X comprises an epoxy group and $R^1$ is independently selected from the group consisting of hydrogen and other groups substantially inert to the polymerization of epoxide group containing compounds; Q is selected from the group consisting of $CR^3_2$, CO, S SO $SO_2$, O, and $NR^3$; wherein $R^3$ is independently selected from the group consisting of H and alkyl groups comprising 1 to 4 carbon atoms.

3. The abrasive article of claim 1 wherein the (b) (iii) modifying component is selected from the group consisting of:

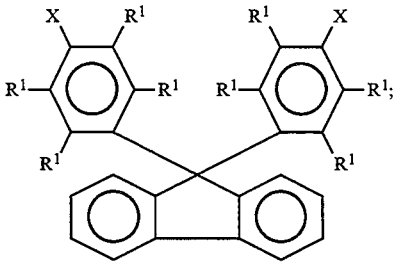

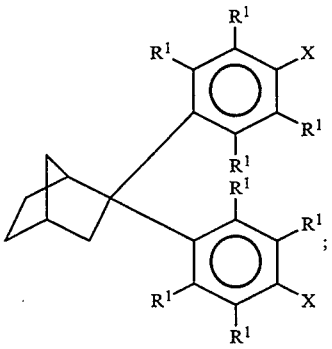

-continued

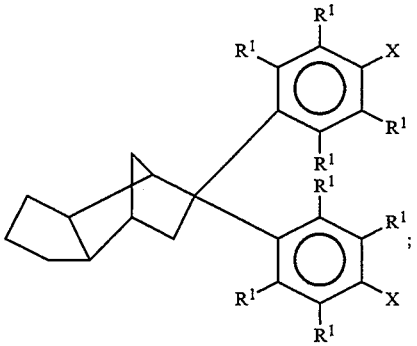

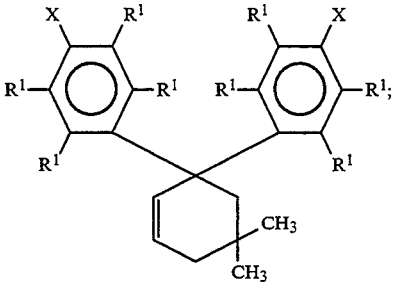

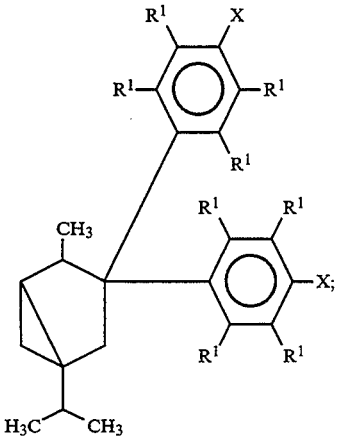

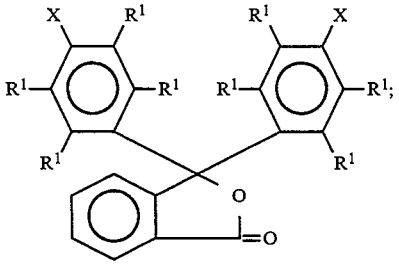

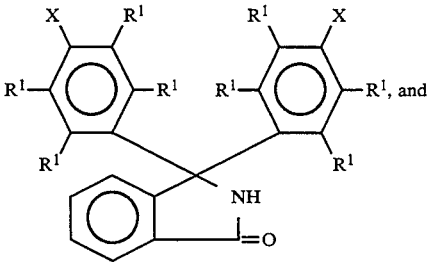

-continued

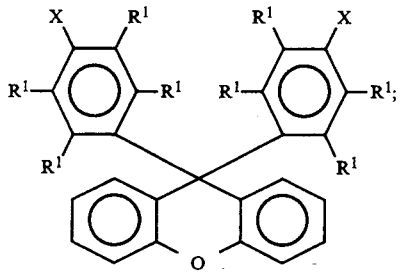

wherein X represents —YH; Y is independently selected from the group consisting of —NH—, —$NCH_3$—, —O—, —S—, and —COO—; and $R^1$ is independently selected from the group consisting of hydrogen and other groups substantially inert to the polymerization of epoxy group containing components; Q is selected from the group consisting of $CR^3_2$, CO, S, SO, $SO_2$, O and $NR^3$; wherein $R^3$ is independently selected from the group consisting of H and alkyl groups comprising 1 to 4 carbon atoms.

4. The abrasive article of claim 1 wherein said modifying component of element (b)(ii) has the formula

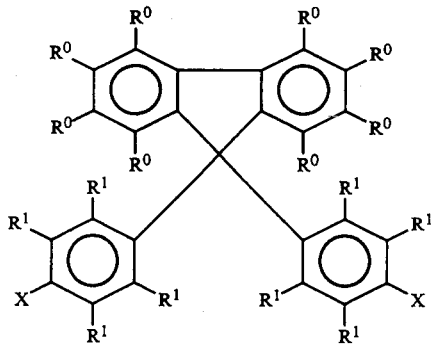

(III)

wherein each $R^0$ and $R^1$ is independently selected from the group consisting of hydrogen and other groups substantially inert to the polymerization of epoxy group containing compounds.

5. The abrasive article of claim 1 wherein said modifying component of element (b)(iii) has the formula

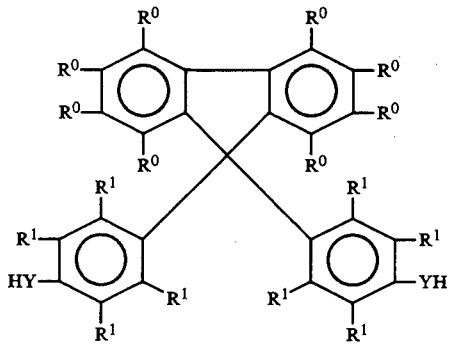

(V)

wherein Y is independently selected from the group consisting of —NH—, —$NCH_3$—, —O—, —S—, —COO—, and mixtures thereof.

6. The abrasive article of claim 1 wherein said binder precursor further comprises about 2 to about 30 percent by weight of a toughening agent based upon the total weight of the precursor composition.

7. The abrasive article of claim 6 wherein said toughening agent is selected from the group consisting of carboxylated acrylonitrile/butadiene vulcanizable elastomer precursors, isocyanate-functional polyethers, and functional acrylic rubbers.

8. The abrasive article of claim 1 wherein said epoxy resin comprises an aromatic polyepoxide.

9. The abrasive article of claim 1 wherein said binder precursor further comprises an additive selected from the group consisting of fillers, grinding aids, and mixtures thereof.

10. The abrasive article of claim 1 wherein the precursor comprises one of the following combination of components selected from the group consisting of:

about 90 to about 10 percent by weight (i), about 95 to about 10 percent by weight (ii), about 10 to about 50 percent by weight (iii), about 1 to about 40 percent by weight (iv);

about 90 to about 50 percent by weight (i), about 90 to about 5 percent by weight (ii), about 10 to about 50 percent by weight (iii);

about 90 to about 50 percent by weight (i), about 95 to about 5 percent by weight (ii), about 1 to about 40 percent by weight (iv);

about 90 to about 50 percent by weight (i), about 10 to about 50 percent by weight (iii);

about 99 to about 60 percent by weight (ii), about 10 to about 50 percent by weight (iii), about 1 to about 40 percent by weight (iv);

about 90 to about 50 percent by weight (ii), about 10 to about 50 percent by weight (iii);

about 99 to about 60 percent by weight (ii), about 1 to about 40 percent by weight (iv);

about 90 to about 50 percent by weight (i), about 10 to about 50 percent by weight (iii), about 1 to about 40 percent by weight (iv);

wherein the weight percentages for each combination are based upon the total weight of the precursor.

11. The abrasive article of claim 1 wherein the precursor comprises one of the following combination of components selected from the group consisting of:

about 75 to about 10 percent by weight (i), about 75 to about 10 percent by weight (ii), about 15 to about 50 percent by weight (iii), about 1 to about 20 percent by weight (iv);

about 75 to about 10 percent by weight (i), about 75 to about 10 percent by weight (ii), about 25 to about 50 percent by weight (iii);

about 75 to about 10 percent by weight (i), about 75 to about 10 percent by weight (ii), about 1 to about 20 percent by weight (iv);

about 85 to about 50 percent by weight (i), about 15 to about 50 percent by weight (iii);

about 75 to about 50 percent by weight (ii), about 25 to about 50 percent by weight (iii), about 1 to about 20 percent by weight (iv);

about 75 to about 50 percent by weight (ii), about 25 to about 50 percent by weight (iii);

about 95 to about 70 percent by weight (ii), about 5 to about 30 percent by weight (iv);

about 85 to about 50 percent by weight (i), about 15 to about 50 percent by weight (iii), about 1 to about 20 percent by weight (iv);

wherein the weight percentages for each combination are based upon the total weight of the precursor.

12. The abrasive article of claim 1 wherein said abrasive article comprises a coated abrasive article.

13. The coated abrasive article of claim 12 wherein said coated abrasive article has a substrate comprising a backing comprising aramid fibers.

14. The abrasive article of claim 1 wherein said abrasive article comprises a nonwoven abrasive article.

15. The abrasive article of claim 1 wherein said abrasive article comprises a bonded abrasive article.

16. The abrasive article of claim 1 wherein said precursor further comprises a thermosetting resin selected from the group consisting of phenolic resins, urea-formaldehyde resins, melamine formaldehyde resins, latices, urethane resins, aminoplast resins, acrylate resins, epoxy resins, isocyanate resins, and mixtures thereof.

17. A nonwoven abrasive article comprising a plurality of abrasive grains bonded into a nonwoven web by a binder wherein the binder comprises a cured precursor wherein the precursor comprises:

(i) optionally an epoxy resin;

(ii) optionally a modifying component selected from the group consisting of modifying components of the general formula:

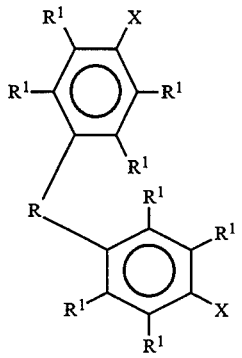

(I)

wherein

X represents an epoxy group;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iii) optionally a modifying component selected from the group consisting of the general formula:

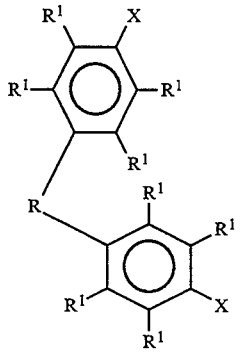

(I)

wherein

X represents —YH;

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iv) optionally a curing agent, wherein said precursor comprises one of the following combination of components selected from the group consisting of:

(i), (iii), and (iv);

(i), (ii), (iii), and (iv);

(i), (ii), and (iii);

(i), (ii), and (iv);

(i) and (iii);

(ii), (iii), and (iv);

(ii) and (iii); and (ii) and (iv);

wherein the epoxy resin of element (b)(i) is defined such that it does not include the modifying component of element (b)(ii), and wherein the curing agent of element (b)(iv) is defined such that it does not include the modifying component of element (b)(iii).

18. A bonded abrasive article comprising a plurality of grains bonded together by a binder to form a shaped mass wherein the binder comprises a cured precursor, wherein the precursor comprises:

(i) optionally an epoxy resin;

(ii) optionally a modifying component selected from the group consisting of modifying components of the general formula:

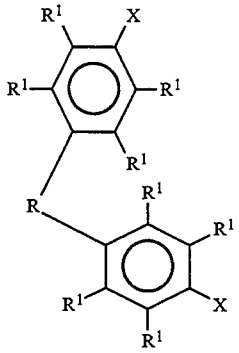

(I)

wherein

X represents an epoxy group;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iii) optionally a modifying component selected from the group consisting of the general formula:

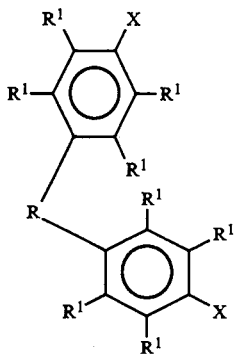

(I)

wherein

X represents —YH;

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iv) optionally a curing agent, wherein said precursor comprises one of the following combination of components selected from the group consisting of:

(i), (iii), and (iv);

(i), (ii), (iii), and (iv);

(i), (ii), and (iii);

(i), (ii), and (iv);

(i) and (iii);

(ii), (iii), and (iv);

(ii) and (iii); and (ii) and (iv);

wherein the epoxy resin of element (b)(i) is defined such that it does not include the modifying component of element (b)(ii), and wherein the curing agent of element (b)(iv) is defined such that it does not include the modifying component of element (b)(iii).

19. A coated abrasive article comprising:

(a) a substrate having a front side and a back side;

(b) at least one layer of abrasive grains bonded to said front side of said substrate by means of a make coat;

(c) optionally one or more additional coats selected from the group consisting of a size coat, a supersize coat, a saturant coat, a presize coat, and a backsize coat;

wherein at least one of said make, size, supersize, saturant, presize, and backsize coats comprises a cured precursor, wherein the precursor comprises:

(i) optionally an epoxy resin;

(ii) optionally a modifying component selected from the group consisting of modifying components of the general formula:

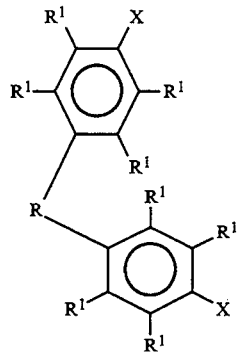

(I)

wherein

X represents an epoxy group;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iii) optionally a modifying component selected from the group consisting of the general formula:

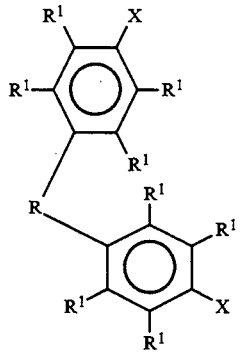

(I)

wherein

X represents —YH;

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iv) optionally a curing agent, wherein said precursor comprises one of the following combination of components selected from the group consisting of:

(i), (iii), and (iv);

(i), (ii), (iii), and (iv);

(i), (ii), and (iii);

(i), (ii), and (iv);

(i) and (iii);

(ii), (iii), and (iv);

(ii) and (iii); and (ii) and (iv);

wherein the epoxy resin of element (b)(i) is defined such that it does not include the modifying component of element (b)(ii), and wherein the curing agent of element (b)(iv) is defined such that it does not include the modifying component of element (b)(iii).

20. A coated abrasive article comprising:

(a) a cloth substrate having a front side and a back side;

(b) at least one layer of abrasive grains bonded to said front side of said cloth substrate by means of a phenolic resin make coat;

(c) one or more additional coats selected from the group consisting of a backsize coat, a saturant coat, and a presize coat;

wherein one or more of said backsize, saturant, and presize coats comprises a cured precursor, wherein the precursor comprises:

(i) optionally an epoxy resin;

(ii) optionally a modifying component selected from the group consisting of modifying components of the general formula:

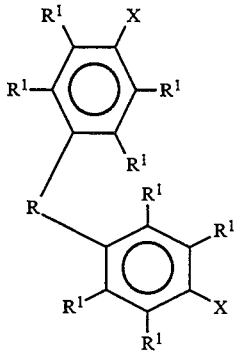

(I)

wherein

X represents an epoxy group;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iii) optionally a modifying component selected from the group consisting of the general formula:

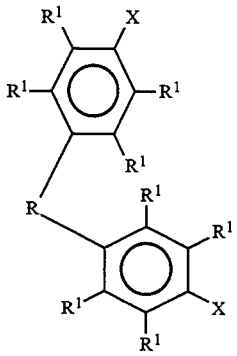

(I)

wherein

X represents —YH;

Y is independently selected from the group consisting of —NH—, $NCH_3$—, —O—, —S—, and —COO—;

R comprises a divalent linking group selected from the group consisting of polycyclic aryls, cyclic alkyls, and polycyclic alkyls; and $R^1$ is independently selected from the group consisting of hydrogen and other groups substantially inert to polymerization of epoxide group containing compounds;

(iv) optionally a curing agent, wherein said precursor comprises one of the following combination of components selected from the group consisting of:

(i), (iii), and (iv);
(i), (ii), (iii), and (iv);
(i), (ii), and (iii);
(i), (ii), and (iv);
(i), and (iii);
(ii), (iii), and (iv);
(ii) and (iii); and
(ii) and (iv);

wherein the epoxy resin of element (b) (i) is defined such that it does not include the modifying component of element (b) (ii), and wherein the curing agent of element (b) (iv) is defined such that it does not include the modifying component of element (b) (iii).

* * * * *

UNITED STATES PATENT AND TRADEMARK OFFICE

CERTIFICATE OF CORRECTION

PATENT NO.: 5,451,446

DATED: September 19, 1995

INVENTOR(S): Don H. Kincaid et al.

It is certified that error appears in the above-identified patent and that said Letters Patent is hereby corrected as shown below:

Col. 11, line 24, delete structure (V) and replace with the following:

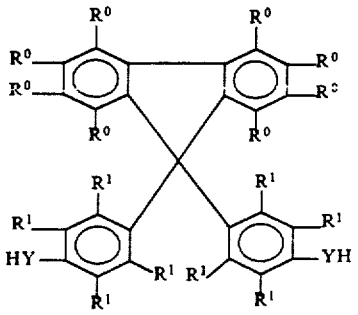

(V)

Col. 12, line 38, delete structure (VII) and replace with the following:

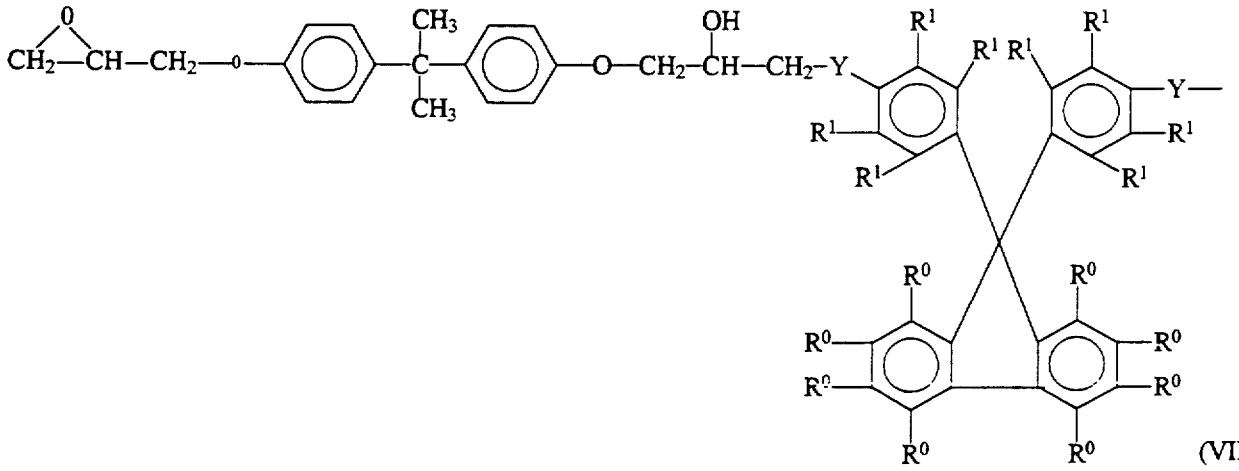

(VII)

UNITED STATES PATENT AND TRADEMARK OFFICE

CERTIFICATE OF CORRECTION

PATENT NO.: 5,451,446

DATED: September 19, 1995

INVENTOR(S): Don H. Kincaid et al.

It is certified that error appears in the above-identified patent and that said Letters Patent is hereby corrected as shown below:

Col. 27, lines 15-25, delete structure and replace with the following:

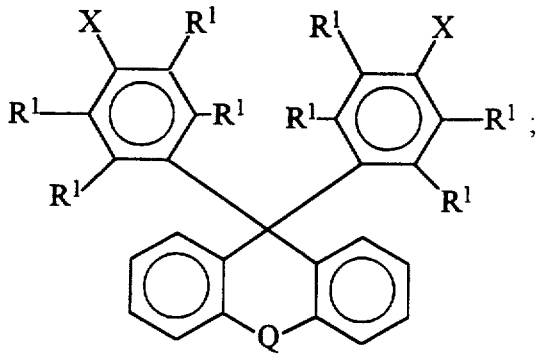

;

Col. 27, line 32, insert a comma between "S and "SO".

UNITED STATES PATENT AND TRADEMARK OFFICE

CERTIFICATE OF CORRECTION

PATENT NO.: 5,451,446

DATED: September 19, 1995

INVENTOR(S): Don H. Kincaid et al.

It is certified that error appears in the above-identified patent and that said Letters Patent is hereby corrected as shown below:

Col. 29, lines 1-13, delete structure and replace with the following:

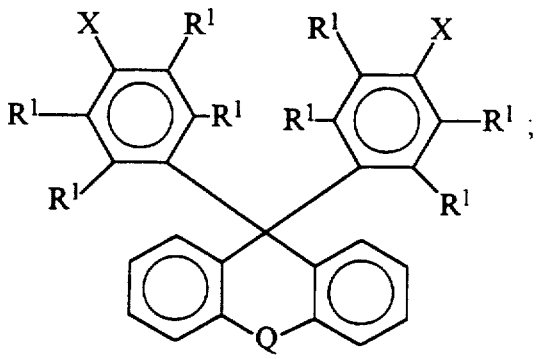

;

Signed and Sealed this

Twenty-third Day of April, 1996

Bruce Lehman

*Attest:*

BRUCE LEHMAN

*Attesting Officer*

*Commissioner of Patents and Trademarks*